US010995291B2

(12) United States Patent
Gomez

(10) Patent No.: US 10,995,291 B2
(45) Date of Patent: May 4, 2021

(54) FUEL COMPOSITIONS

(71) Applicant: Alexander R. Gomez, Lafayette, LA (US)

(72) Inventor: Alexander R. Gomez, Lafayette, LA (US)

(73) Assignee: HKA Hydrofuel, LLC, Lafayette, LA (US)

( * ) Notice: Subject to any disclaimer, the term of this patent is extended or adjusted under 35 U.S.C. 154(b) by 0 days.

(21) Appl. No.: 16/350,655

(22) Filed: Dec. 15, 2018

(65) Prior Publication Data

US 2020/0190419 A1 Jun. 18, 2020

(51) Int. Cl.

| | |
|---|---|
| ***C10L 1/16*** | (2006.01) |
| ***C10L 1/12*** | (2006.01) |
| ***C10L 1/19*** | (2006.01) |
| ***C10L 1/182*** | (2006.01) |
| ***C10L 1/198*** | (2006.01) |
| ***C10L 1/23*** | (2006.01) |
| ***C10L 1/222*** | (2006.01) |
| *C10L 1/10* | (2006.01) |

(52) U.S. Cl.

CPC ..... *C10L 1/1608* (2013.01); *C10L 1/125* (2013.01); *C10L 1/1826* (2013.01); *C10L 1/19* (2013.01); *C10L 1/1985* (2013.01); *C10L 1/222* (2013.01); *C10L 1/231* (2013.01); *C10L 1/106* (2013.01); *C10L 2230/22* (2013.01); *C10L 2270/023* (2013.01); *C10L 2300/20* (2013.01)

(58) Field of Classification Search

CPC ..... C10L 1/1608; C10L 1/125; C10L 1/19; C10L 1/1826; C10L 1/1985; C10L 1/231; C10L 1/222; C10L 1/106; C10L 2230/22; C10L 2300/20; C10L 2270/023

See application file for complete search history.

(56) References Cited

U.S. PATENT DOCUMENTS

| | | | | |
|---|---|---|---|---|
| 4,877,414 | A | 10/1989 | Mekonen | |
| 7,182,797 | B2 | 2/2007 | Mekonen | |
| 2013/0291429 | A1* | 11/2013 | Furukawa | C10L 1/328 44/302 |

FOREIGN PATENT DOCUMENTS

| | | |
|---|---|---|
| WO | WO 2000/000572 A2 | 1/2000 |
| WO | WO 2005/037961 A2 | 6/2006 |
| WO | WO 2011/028182 | 3/2011 |

OTHER PUBLICATIONS http://www.advancedwaterfilters.com/faq-water-softener-and-conditioning/ (Year: 0000).*

* cited by examiner

*Primary Examiner* — Cephia D Toomer
(74) *Attorney, Agent, or Firm* — Michael D. Carbo

(57) ABSTRACT

Improved fuel compositions and fuel additive packages which serve to prolong stability at various ambient conditions and to increase fuel efficiency and fuel economy while also significantly reducing the level of multiple emissions constituents generated upon combustion of the fuels including $CO_2$, $NO_X$, $SO_X$, Particulate Matter PM2.5, PM10 and Black Carbon. The fuels may include the hydrocarbon fuels gasolines, diesel fuels, biodiesel fuels, biomass diesel fuels, renewable fuels, synthetic fuels, algae-based fuels, kerosene fuel or heavy fuel oils, or may alternatively be hydrosols, and include an additive package having a sorbitan oleate, a polyoxyethylene alcohol, an alkylene glycol, and an amine. The fuels are mixed with an additive and are emulsified with clean, soft water having a water quality of 1 micron or less.

35 Claims, No Drawings

FUEL COMPOSITIONS

BACKGROUND OF THE INVENTION

1. Field of the Invention

The present invention is broadly concerned with improved fuel compositions and additive packages in emulsified (hydrosols) and non-emulsified fuels thereof, which are capable of prolonged stability at different ambient conditions and increased fuel efficiency (work output enhancements) and fuel economy while also significantly reducing the level of multiple emissions constituents generated upon combustion of the fuels including $CO_2$, $NO_X$, $SO_X$, Particulate Matter PM2.5, PM10 and Black Carbon and doing so in an economical fashion. The fuels may include the hydrocarbon fuels gasolines, diesel fuels, biodiesel fuels, biomass diesel fuels, renewable fuels, synthetic fuels, algae-based fuels, kerosene fuel or heavy fuel oils, or may alternatively be hydrosols, and include an additive package having a sorbitan oleate, a polyoxyethylene alcohol, an alkylene glycol, and an amine.

2. Description of the Prior Art

Additives have been proposed in the past to reduce problems related to mechanical noise in leaded hydrocarbon fuels and to improve the engine efficiency and performance for standard hydrocarbon fuels.

Studies related to water-blended fuels (hydrosols) have shown that engine performance and exhaust characteristics change when water is present during the combustion process. On one hand, combustion temperatures reduce and the calorific value of the hydrosol fuel with high water concentrations is lowered, which could be problematic for engine ignition. On the other hand, blending hydrocarbon fuel with water reduces the amount of fossil fuels used and the corresponding cost of the hydrocarbon.

Surface-active agents (surfactants) can be added to emulsified fuels to reduce the tendency for water-hydrocarbon bonds to break leading to separation over time. To keep the mixture both stable and inexpensive, small quantities of surfactants are used as oils (hydrocarbon fuels) and water naturally repel over time.

PCT Publication No. WO 86/00333 (Coll Feliu publication) describes improved hydrosols made up of a hydrocarbon fuel, water, a stabilizing surfactant and up to about 2.5% by weight of a polyolefin. This is asserted to increase the combustion efficiency, cetane and octane rating of the fuels.

U.S. Pat. No. 4,877,414 to Mekonen describes fuel compositions in the form of traditional hydrocarbon fuels or hydrosols, which include the addition of alpha olefins and alkyl benzenes. Similarly, U.S. Pat. No. 5,372,613 to Mekonen discloses fuel compositions which are improved by the addition of an organic titanate.

U.S. Pat. No. 7,182,797 to Mekonen describes fuel compositions comprising essentially water-free hydrocarbon fuels in the form of hydrosols and also describes fuel additive packages, which include sorbitan oleate, a polyoxyethylene alcohol, an alkylene glycol, and an amine, and focuses on hydrosols made up of a hydrocarbon fuel, water, and a stabilizing surfactant, with improved fuel compositions having twin characteristics of enhanced combustion efficiency and, at the same time, reduced $CO_2$ emissions.

PCT Publication No. WO/2011/028182 (Teo publication) describes a process of manufacturing biodiesel and glycerin, organic fuel additive compositions and emulsion fuels, and the organic fuel additive compositions and emulsion fuels manufactured by the process. These prior art references are primarily concerned with increasing combustion efficiencies of fuels, and the '797 patent to Mekonen is concerned also with reducing $CO_2$ emissions. However, issues related to emissions of greenhouse gases, particularly emissions of $NO_X$ and $SO_X$, Particulate Matter (PM), are as important as the environmental concerns related to $CO_2$. NOx and $SO_X$, Particulate Matter, including PM2.5, PM10 and Black Carbon emissions, have adverse health effects, including decreased lung function, increased risk of respiratory conditions, and increased response to allergens, and they reduce the performance of combustion engines and related systems. All of these matters are of concern in both warm and cold weather.

The Teo publication is concerned also with reduction of environmental pollution, discloses that conventional water-based emulsion diesel suffers from decreased fuel power and the higher cost incurred in the manufacture process, and discloses organic fuel additive compositions comprising surfactant, glycerin, polyethoxy-ester, water, and diesel, whereby all components are admixed together to form the organic fuel additive composition, the only disclosed characteristic of the water being a pH value of between 6.8 and 7.2.

Therefore, there is a need in the art for improved fuel compositions having a multifaceted ability to:

i) reduce adverse environmental effects of combustion emissions by substantially reducing emissions of $CO_2$, NOx, $SO_X$, Particulate Matter PM2.5, PM10 and Black Carbon;

ii) reduce adverse environmental effects and costs associated with fuel spills, storage and transportation by achieving a higher flash point, fewer pollution characteristics and a lower hazardous materials classification as compared with conventional fuels in the market;

iii) reduce adverse health effects on humans by obtaining a reduction in fuel toxicity by reducing particulate matter and black carbon emissions by up to 90% as compared with standard fuels;

iv) improve combustion engine performance, including fuel efficiency (work output enhancements), fuel economy, engine temperature, and noise, regardless of climate zone or ambient temperature conditions;

v) reduce wear and tear on mechanical components of engines as a result of decarbonization (acting as a cleaning agent) and engine exhaust, and increase lubricity of the fuel, all of these enhancements being characterized by lower engine operating temperatures of up to 20% (reducing engine stress) and reduction of fouling of engine ignitors, sensors and emissions reduction equipment, thereby contributing to reducing direct maintenance costs and increasing engine and component longevity; and vi) reduce engine noise by up to 5%, thereby reducing noise pollution and cabin noise levels, demonstrating that engine mechanical components are better lubricated and that an engine operates with less stress.

SUMMARY OF THE INVENTION

The present invention overcomes the problems outlined above and provides improved fuel compositions and improved additive packages to be used with fuels. The fuel compositions and additive packages of the present invention significantly reduce $CO_2$, $NO_X$, $SO_X$, PM2.5, PM10 and Black Carbon emissions generated upon combustion of the fuels in both warm and cold temperatures up to 90% as compared with standard fuels. Further, the improved fuel compositions and additive packages deliver improved fuel economy and lower engine wear and reduced maintenance due to lower engine temperature and lower mechanical friction and noise as a result of higher fuel lubricity. Broadly speaking, the base fuels of the invention are essentially water-free hydrocarbon fuels such as gasolines, diesel fuels, biodiesel fuels, biomass diesel fuels, renewable fuels, synthetic fuels, heavy fuel oil, kerosene fuel, biofuels, and algae-fuels or, alternatively, hydrosols comprising such hydrocarbon fuels with added water and containing a substantial fraction of water with a hydrocarbon fuel. When the fuels are mixed with an additive according to the present invention and further emulsified with clean, soft water having a water quality of 1 micron or less, substantial improvements in fuel stability and engine performance are achieved. When coupled with enhanced submicron emulsification techniques or enhanced low nano-emulsification techniques, an emulsified fuel-water additive package that is stable up to one year or longer can be achieved.

The improved additive package is adjustable to various industry applications, based on market demand, without engine modifications or retrofits. The improved formulation will cater to market requirements related to shelf-life and the need for intermixing with base fuels (back and forth with no adverse effects.) This includes adjustments not limited to Cetane Improver, lubricity, viscosity, density, antioxidants, and biocides for long term storage, flash point, heat of combustion, and work output enhancements.

Under certain applications, small amounts of additional additives are added to the mixture to enhance fuel characteristics for climate, temperature, and performance. Nitrate (2-ethyl hexyl nitrate) is added to the mixture to improve the cetane value of the fuel. Ethylene glycol is added to the mixture as a pourpoint suppressant in extreme cold climate conditions. Methanol is added also as a pourpoint suppressant and antifreeze for cold climate conditions. Methanol also contains inherently high oxygen content that results in higher work output of the engine upon combustion while simultaneously reducing CO (carbon monoxide) emissions.

In any case, the additive package used with such base fuels includes respective quantities of a sorbitan oleate, a polyoxyethylene alcohol, an alkylene glycol, and an amine.

It is believed that the presence of the amine (which may be primary, secondary, or tertiary amine or amine derivative) is instrumental in reducing $CO_2$ emissions incident to combustion of the fuels. Specifically, it is theorized that the amine reacts catalytically with hydrogen in the fuel (which may be derived from the glycol component) to produce ammonia; the ammonia then reacts with $CO_2$ to yield ammonium carbamate. The carbamate in turn is dehydrated by the heat of combustion to give urea and water. The remaining named constituents, $NO_X$, $SO_X$, Particulate Matter PM2.5, PM10 and Black Carbon, are reduced by a combination of the chemical reaction taking place during the combustion process as well as, in the case of the hydrosols, a natural reaction on account of the hydrocarbon fuel displacement by the quantity of soft the water used in the emulsification In preferred forms, the additive package includes quantities of sorbitan monooleate and sorbitan sesquioleate as the total oleate fraction. Similarly, the POE alcohol is advantageously present as POE(3) tridecyl alcohol and POE(6) tridecyl alcohol. Various other optional ingredients may also be used in the additive packages, especially toluene, xylene, VMP naphtha (in the case of water-free fuels), and alkyl benzene.

DETAILED DESCRIPTION OF THE INVENTION

As noted above, the fuel compositions of the present invention broadly include a combustible hydrocarbon-based fuel and an additive package mixed with the fuel. The fuels may be traditional, essentially water-free hydrocarbon fuels such as gasolines, diesel fuels, biodiesel fuels, biomass diesel fuels, renewable fuels, synthetic fuels, heavy fuel oil, kerosene fuel, biofuels, and algae-fuels or, alternatively, hydrosols comprising such hydrocarbon fuels with added water and containing a substantial fraction of water with a hydrocarbon fuel. In all instances, the additive package is present in relatively small amounts, normally on the order of from about 0.16-3.00 fluid ounces of additive package/gallon of hydrocarbon-based fuels. It will be appreciated, however, that the amount of additive package used is based upon the exact makeup of the package, the desired fuel performance, the cost of the additive package, and the duration of emulsification stability required. Further, the fuel-water and additive package will obtain enhanced shelf life stability and performance characteristics with the use of clean (purified) water. Soft water should be used and the water should be purified to 1 micron or less, and bacteria should be eliminated by methods such as UV lighting.

The additive package of the invention has slightly different makeups when used with essentially water-free fuels, versus hydrosols. In all instances though, the additive package includes respective quantities of a sorbitan oleate, a polyoxyethylene alcohol, an alkylene glycol, and an amine.

The sorbitan oleate component is preferably made up of individual quantities of sorbitan monooleate and sorbitan sesquioleate, with a total sorbitan oleate fraction being used set forth in the following Tables. The oleates are useful as coupling and dispersing agents in the improved fuels of the invention.

The polyoxyethylene alcohol component can be variable, but in most preferred cases it compromises a combination of 3 and 6 molar ethoxylates of a C6-C22 alcohol (e.g., tridecyl alcohol), i.e., POE(3) and POE(6)alcohols. The overall alcohol content of the fuels, and the preferred contacts of the POE(3) and POE(6) are set forth below.

The additive packages also contain an alkylene glycol, which serve as a source of hydrogen radicals. Preferably, the glycols are C2-C8 glycols, most preferably hexylene glycol.

The amine component of the additive packages can be in the form of a primary, secondary (e.g., ethoxylated fatty acid amines), or tertiary amine or amine derivative. For reasons of cost, the primary amines are preferred, these having the formula R—NH2, where R is selected from the group consisting of C1-C18 straight or branched chain alkyl, alkenyl, and alkynyl groups, aryl groups, and organic heteroatom groups containing an O, S or N ion. Most preferably though, the primary amines are selected from the group consisting of C1 C12 alkyl amines. More specifically, the following alkylamines are particularly useful: isopropylamine, CAS #75-31-0, ethylamine, CAS #75-04-7, diethylamine, CAS #109-89-7, and triethylamine, CAS #121-44-8. Alkanolamines are also useful, e.g., monoethanolamine, CAS #141-43-5, diethanolamine, CAS #111-42-2, triethanolamine, CAS #102-71-6.

The following Table 1 sets forth additional operative amines useful in the invention.

| Product Name | CAS number | CAS Name | Alternative CAS Number | CAS Name |
|---|---|---|---|---|
| E-14-2 | 68478-95-5 | Poly(oxy-1,2-ethanediyl), a,a[1]-(iminodi-2,1-ethanediyl)bis]w-hydroxy-, N-[3-(branched decyloxy)propyl] derivatives. | 218141-23-2 | Poly(oxy-1,2-ethanediyl),a,a[1]-(limiodi-2,1-ethanediyl)bis[w-hydroxy-,N-[2-(C9-11-isoalkyloxy)propyl] derivs., C10 rich |
| E-14-5 | 68478-95-5 | Poly(oxy-1,2-ethanediyl), a,a[1]-(iminodi-2,1-ethanediyl)bis]w-hydroxy-, N-[3-(branched decyloxy)propyl] derivs. | 218141-23-2 | Poly(oxy-1,2-ethanediyl),a,a[1]-(limiodi-2,1-ethanediyl)bis[w-hydroxy-,N-[2-(C9-11-isoalkyloxy)propyl] derivs., C10 rich |
| E-17-2 | 68478-96-5 | Poly(oxy-1,2-ethanediyl), a,a[1]-(iminodi-2,1-ethanediyl)bis]w-hydroxy-, N-[3-(branched tridecyloxy)propyl] derivs. | 223129-76-8 | Poly(oxy-1,2-ethanediyl),a,a[1]-(limiodi-2,1-ethanediyl)bis[w-hydroxy-,N-[2-(C13-rich, 11-14 isoalkyl)oxy]propyl] derivs. |
| E-17-5 | 68478-96-6 | Poly(oxy-1,2-ethanediyl), a,a[1]-(iminodi-2,1-ethanediyl)bis]w-hydroxy-, N-[3-(branched tridecyloxy)propyl] derivs. | 223129-76-8 | Poly(oxy-1,2-ethanediyl),a,a[1]-(limiodi-2,1-ethanediyl)bis[w-hydroxy-,N-[2-(C13-rich, 11-14 isoalkyl)oxy]propyl] derivs. |
| E-S-15 | 61791-24-0 | Amines, soya alkyl, ethoxylated | | |
| E-S-2 | 61791-24-0 | Amines, soya alkyl, ethoxylated | | |
| E-S-3.5 | 61791-24-0 | Amines, soya alkyl, ethoxylated | | |
| E-S-5 | 61791-24-0 | Amines, soya alkyl, ethoxylated | | |

The additive packages may also have a number of optional ingredients, such as individual quantities of toluene and xylene, the latter normally being in equal quantities. Where an essentially water-free fuel is being supplemented, the additive package may also include VMP naphtha. Other optional ingredients may include alkyl benzene, and an alpha olefin (e.g., decene-1). The alkyl benzene aids in the lubricity of the fuels and cleavage of hydrocarbon molecules. The alpha olefin increases the power factor of the complete fuels.

The following tables 2-5 set forth ranges of use for the components of water-free and hydrosol fuels in accordance with the invention, as well as additive packages for incorporation into water-free fuels and hydrosols; the tables include information respecting generic components as well as preferred components. In Table 2 and 3 relating to complete fuels, the ranges are expressed as percentages by weight, based upon the total weight of the fuels taken as 100% by weight. In Tables 4 and 5 to the additives per se, the ranges are expressed as percentages by weight, based upon the total weight if the additive packages taken as 100% by weight.

TABLE 2

| WATER-FREE FUELS | | | |
|---|---|---|---|
| FUEL CONSTITUENT | CAS NO. | BROAD RANGE | PREFERRED |
| Hydrocarbon-based fuel | n/a | 67.50-97.90% | 84.50% |
| Total additive package | n/a | 2.10-12.50% | 15.50% |
| Total sorbitan oleate | n/a | 1.80-6.00% | 3.75% |
| a. Sorbitan monooleate | 1338-43-8 | 0.90-2.50% | 1.25% |
| b. Sorbitan sesquioleate | 8007-43-0 | 0.90-3.50% | 2.50% |
| Total POE alcohol | n/a | 3.00-8.00% | 5.00% |
| a. POE(3) tridecyl alcohol | 78330-21-9 | 2.00-5.00% | 1.66% |
| b. POE(6) tridecyl alcohol | 78330-21-9 | 1.00-3.00% | 3.34% |
| Alkylene glycol | n/a | 0.25-0.75% | 0.30% |
| Amine | n/a | 0.05-5.00% | 3.00% |
| Toluene | 108-88-3 | 0.05-5.00% | 0.75% |
| Xylene | 1330-20-7 | 0.05-5.00% | 0.75% |
| VMP naptha | 68410-97-9 | 0.50-10.00% | 1.50% |
| Alkyl benzene | 68855-24-3 | 0.05-5.00% | 0.50% |

TABLE 3

| HYDROSOLS | | | |
|---|---|---|---|
| FUEL CONSTITUENT | CAS NO. | BROAD RANGE | PREFERRED |
| Hydrocarbon-based fuel | n/a | 67.80-93.40% | 75.50% |
| Soft Water with 1 micron or less purity | n/a | 5.00-25.00% | 20.00% |
| Total additive package | n/a | 0.75-6.00% | 4.50% |
| Total sorbitan oleate | n/a | 0.45-3.00% | 0.90% |
| a. Sorbitan monooleate | 1338-43-8 | 0.30-2.0% | 0.60% |
| b. Sorbitan sesquioleate | 8007-43-0 | 0.15-1.00% | 0.30% |
| Total POE alcohol | n/a | 0.15-0.60% | 0.60% |
| a. POE(3) tridecyl alcohol | 78330-21-9 | 0.10-0.40% | 0.40% |
| b. POE(6) tridecyl alcohol | 78330-21-9 | 005-0.20% | 0.20% |
| Alkylene glycol | n/a | 0.10-0.30% | 0.20% |
| Amine | n/a | 0.05-0.50% | 0.40% |
| Toluene | 108-88-3 | 0.10-0.50% | 0.35% |
| Xylene | 1330-20-7 | 0.10-0.50% | 0.35% |
| Alkyl benzene | 68855-24-3 | 0.10-0.40% | 0.20% |

TABLE 4

| ADDITIVE PACKAGES FOR WATER-FREE FUELS | | | |
|---|---|---|---|
| ADDITIVE PACKAGE CONSTITUENT | CAS NO. | BROAD RANGE | PREFERRED |
| Total sorbitan oleate | n/a | 0.45-3.00% | 1.50% |
| a. Sorbitan monooleate | 1338-43-8 | 0.15-1.00% | 0.50% |
| b. Sorbitan sesquioleate | 8007-43-0 | 0.30-2.00% | 1.00% |
| Total POE alcohol | n/a | 0.10-3.00% | 1.50% |
| a. POE(3) tridecyl alcohol | 78330-21-9 | 0.05-2.00% | 1.00% |
| b. POE(6) tridecyl alcohol | 78330-21-9 | 0.05-1.00% | 0.50% |
| Alkylene glycol | n/a | 0.05-1.00% | 0.50% |
| Amine | n/a | 0.05-5.00% | 3.00% |
| Toluene | 108-88-3 | 0.05-5.00% | 1.50% |
| Xylene | 1330-20-7 | 0.05-5.00% | 1.50% |
| VMP naptha | 68410-97-9 | 67.80-95.00% | 90.00% |
| Alkyl benzene | 68855-24-3 | 0.50-1.00% | 0.50% |

TABLE 5

| ADDITIVE PACKAGES FOR HYDROSOLS | | | |
|---|---|---|---|
| ADDITIVE PACKAGE CONSTITUENT | CAS NO. | BROAD RANGE | PREFERRED |
| Total sorbitan oleate | n/a | 4.00-25.00% | 18.00% |
| a. Sorbitan monooleate | 1338-43-8 | 1.00-10.00% | 6.00% |
| b. Sorbitan sesquioleate | 8007-43-0 | 3.00-15.00% | 12.00% |
| Total POE alcohol | n/a | 1.50-15.00% | 9.00% |
| a. POE(3) tridecyl alcohol | 78330-21-9 | 1.00-10.00% | 6.00% |
| b. POE(6) tridecyl alcohol | 78330-21-9 | 0.50-5.00% | 3.00% |
| Alkylene glycol | n/a | 0.50-3.00% | 2.00% |
| Amine | n/a | 1.00-10.00% | 5.00% |
| Toluene | 108-88-3 | 5.00-40.00% | 32.50% |
| Xylene | 1330-20-7 | 5.00-40.00% | 32.50% |
| Alkyl benzene | 68855-24-3 | 0.05-2.00% | 1.00% |

Although not wishing to be bound by any theory, it is believed that the presence of the amine in the improved additive packages, the soft water purity quality of approximately 1 micron or less, and the submicron nano-emulsification, as well as the improved fuels of the invention, aid in decreasing $CO_2$, $NO_X$, $SO_X$, PM2.5, PM10 and Black Carbon emissions upon combustion of the fuels. That is, the amine reacts catalytically with hydrogen present in the fuel mixture by virtue of the glycol fraction to generate ammonia. The ammonia then reacts with $CO_2$ to form ammonium carbamate, which is in turn dehydrated during combustion to yield urea and water. These reactions are exemplified by the following, where use is made of a primary amine. The remaining constituents are reduced by a combination of the chemical reaction taking place during the combustion process as well as, in the case of the hydrosols, a natural reduction on account of the hydrocarbon fuel displacement by the quantity of soft water used in the emulsification.

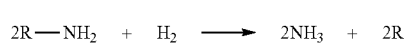

(1)

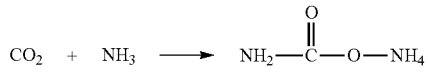

(2)

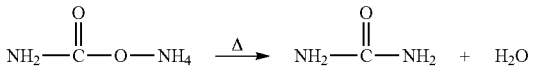

(3)

As can be seen, this reaction scheme is both simple and environmentally benign, yielding only water and urea as end products. However, significant quantities of $CO_2$, $NO_X$, $SO_X$, PM2.5, PM10 and Black Carbon are taken up, resulting in lessened emissions thereof. The fuels of the invention should exhibit up to 90% reduction in emissions, as compared with present-day conventional fuels.

TABLE 6

| ASTM D-975 Ultra Low Sulfur Diesel Scenario | | | | |
|---|---|---|---|---|
| Test | Procedure | Min | Max | Hydrosol Invention |
| Flash Point PMCC | ASTM D93 | 52 | — | 61.1° C. |
| Density | ASTM D4052 | 0.820 | 0.860 | 0.850 g/cm3 |
| API Gravity @ 15° C. | ASTM D4052 | — | — | 35.2 Deg. API |

TABLE 6-continued

| ASTM D-975 Ultra Low Sulfur Diesel Scenario | | | | |
|---|---|---|---|---|
| Test | Procedure | Min | Max | Hydrosol Invention |
| Viscosity - Kinematic @ 40° C. | ASTM D445 | 1.9 | 4.1 | 2.63 mm2/s |
| Ash | ASTM D482 | — | 0.010 | <0.001 Mass % |
| Copper Corrosion @ 50° C. | ASTM D130 | — | 3 | 1 A 3 hr |
| Cetane Index | ASTM D976 | 40 | — | 45 |
| Lubricity by HFRR @ 60°C | ASTM D6079 | — | 520 | 330 um |
| Distillation 90% Recovered | ASTM D86 | 282 | 338 | 326.6° C. |
| Conductivity | ASTM D2624 | 25 | — | >2000 pSm |
| Cold Filter Plugging Pt. | ASTM D6371 | — | — | −28° C. |
| Pour Point | ASTM D97 | — | — | −18° C. |
| Cloud Point | ASTM D2500 | — | — | −0.5° C. |
| Sediment and Water (free water) | ASTM D2709 | — | 0.05 | 0.00% Vol |
| Aromaticity by FIA | ASTM D1319 | — | 35 | 11.3% Vol |

Any fossil fuel, including gasoline, can be emulsified, although diesel fuel works best. Emulsification of water in hydrocarbon-based and other fuels, such as hydrosols, creates micelles. Cavitation processes at high pressure and relatively constant temperature will produce appropriately small fuel micelles for use in fuels and additives according to the invention. Cavitation processes will reduce the size of fuel micelles.

It has been discovered that an inline high pressure multi-cavitation force emulsion process, not requiring recirculation of mixture provides enhanced submicron emulsification and low nano-emulsification, resulting in prolonged stability at various ambient conditions and also resulting in increased fuel efficiency (work output enhancements) and fuel economy while also significantly reducing the level of multiple emissions constituents generated upon combustion of the fuels.

As a nonlimiting example, Table 6 shows test results for the enhanced submicron emulsified technique with ASTM D-975 Ultra Low Sulphur Diesel Fuel in an inline high pressure multi-cavitation force emulsification process not requiring recirculation of mixture, according to the invention that has been tested under relevant standard test methods. Enhanced submicron emulsification using ultra-filtered soft water substantially improved test results over that of fuels that had been emulsified without the use of soft, ultra-filtered (filtered to submicron level) water and/or non-enhanced submicron emulsification.

Likewise, engines using fuels or additive packages prepared with emulsifications of ultra-filtered, soft water according to the present invention had substantially reduced emissions of $CO_2$, $NO_X$, $SO_X$, Particulate Matter PM2.5, and PM10.

The invention claimed is:

1. A fuel composition comprising a combustible hydrocarbon-based fuel and an additive package mixed with said fuel, said additive package being present at a level for reducing the amount of $CO_2$, $NO_X$, $SO_X$, PM2.5, PM10 and Black Carbon emissions generated upon combustion of the fuel composition as compared with an otherwise identical fuel composition in the absence of said additive package, said additive package including respective quantities of synthetic surfactants, sorbitan oleate, a polyoxyethylene alcohol, an alkylene glycol, and an amine, and said additive package containing soft water purified by filtration to approximately 1 micron or smaller.

2. The fuel composition of claim 1, said hydrocarbon-based fuel selected from the group consisting of gasolines, diesel fuels, biodiesel fuels, biomass diesel fuels, renewable fuels, synthetic fuels, algae-based fuels, kerosene fuel or heavy fuel oils, or may alternatively be hydrosols containing a substantial fraction of water with a hydrocarbon fuel.

3. The fuel composition of claim 1, said hydrocarbon-based fuel being a hydrosol and comprising a hydrocarbon fuel and an amount of soft water purified by filtration to approximately 1 micron or smaller.

4. The fuel composition of claim 3, said hydrosol containing from about 5-30% by weight soft water purified to approximately 1 micron or smaller, based upon the total weight of the fuel composition taken as 100% by weight.

5. The fuel composition of claim 1, including individual quantities of synthetic or organic surfactants, sorbitan monooleate and sorbitan sesquioleate.

6. The fuel composition of claim 1, said fuel composition of said additive package including respective quantities of synthetic or organic surfactants, for which the surfactants being about 1.8-5.00% by weight, based upon the total weight of the fuel composition taken as 100% by weight.

7. The fuel composition of claim 1, said fuel composition being essentially water-free, said sorbitan oleate being present at a level of from about 1.8-5.00% by weight, based upon the total weight of the fuel composition taken as 100% by weight.

8. The fuel composition of claim 1, said polyoxyethylene alcohol comprising POE (6) tridecyl alcohol.

9. The fuel composition of claim 7, said fuel composition being essentially water-free, said polyoxyethylene alcohol being present at a level of from about 3.00-8.00% by weight, based upon the total weight of the fuel composition taken as 100% by weight.

10. The fuel composition of claim 1, said alkylene glycol comprising hexylene glycol.

11. The fuel composition of claim 1, said fuel composition being essentially water-free, said alkylene glycol being present at a level of from about 0.25-0.75% by weight, based upon the total weight of the fuel composition taken as 100% by weight.

12. The fuel composition of claim 1, said amine being a primary amine having the formula R—$NH_2$, where R is selected from the group consisting of C1-C18 straight or branched chain alkyl, alkenyl, and alkynyl groups, aryl groups, and organic heteroatom groups containing an O, S or N.

13. The fuel composition of claim 11, said amine selected from the group consisting of C1-C12 alkyl amines.

14. The fuel composition of claim 1, said fuel composition being essentially water-free, said amine being present at a level of from about 0.05-5.00% by weight, based upon the total weight of the fuel composition taken as 100% by weight.

15. The fuel composition of claim 1, said additive package further including individual quantities of toluene and xylene.

16. The fuel composition of claim 14, said additive package including equal quantities of toluene and xylene.

17. The fuel composition of claim 15, said fuel composition being essentially water-free, said quantities of toluene and xylene together totaling from about 0.10-10.00% by weight, based upon the total weight of the fuel composition taken as 100% by weight.

18. The fuel composition of claim 1, said fuel composition being essentially water-free, said additive package including naptha present at a level of from about 0.5-10.00% by weight, based upon the total weight of the fuel composition taken as 100% by weight.

19. The fuel composition of claim 1, said additive package being present at a level of from about 0.16-0.64 fluid ounces/gallon of hydrocarbon-based fuel.

20. The fuel composition of claim 18, said fuel being a gasoline, said additive package being present at a level of from about 0.16-0.48 fluid ounces/gallon of gasoline.

21. The fuel composition of claim 18, said fuel being selected from the group consisting of diesel fuel, biodiesel fuel, biomass diesels fuel, or algae-based diesel fuel, kerosene and heavy fuel oils, said additive package being present at a level of from about 0.32-3.00 fluid ounces/gallon of said fuel being selected from the group consisting of diesel fuel, biodiesel fuel, biomass diesel fuels, or algae-based diesel fuel, kerosene and heavy fuel oils.

22. The fuel composition of claim 1, said fuel composition being a hydrosol, said sorbitan oleate being present at a level of from about 0.45-3.00% by weight, based upon the total weight of the fuel composition taken as 100% by weight.

23. The fuel composition of claim 1, said fuel composition being a hydrosol, said polyoxyethylene alcohol being present at a level of from about 0.15-0.60% by weight, based upon the total weight of the fuel composition taken as 100% by weight.

24. The fuel composition of claim 1, said fuel composition being a hydrosol, said alkylene glycol being present at a level of from about 0.10-0.30% by weight, based upon the total weight of the fuel composition taken as 100% by weight.

25. The fuel composition of claim 1, said fuel composition being a hydrosol, said amine being present at a level of from about 0.05-2.50% by weight, based upon the total weight of the fuel composition taken as 100% by weight.

26. The fuel composition of claim 15, said fuel composition being a hydrosol, said quantities of toluene and xylene together totaling from about 0.20-5.00% by weight, based upon the total weight of the fuel composition taken as 100% by weight.

27. An additive package for mixing with a hydrocarbon-based fuel and operable to reduce $CO_2$, $NO_X$, $SO_X$, Particulate Matter PM2.5, PM10 and Black Carbon emissions generated upon combustion of the fuel, said additive package including respective quantities of a sorbitan oleate, a polyoxyethylene alcohol, an alkylene glycol, and an amine, and said additive package containing soft, submicron purity filtered water.

28. The additive package of claim 27, including individual quantities of sorbitan monooleate and sorbitan sesquioleate.

29. The additive package of claim 27, said polyoxyethylene alcohol comprising POE (6) tridecyl alcohol.

30. The additive package of claim 27, said alkylene glycol comprising hexylene glycol.

31. The additive package of claim 27, said amine being a primary amine having the formula R—$NH_2$, where R is selected from the group consisting of C1-C18 straight or branched chain alkyl, alkenyl, and alkynyl groups, aryl groups, and organic heteroatom groups containing an O, S or N.

32. The additive package of claim 31, said amine selected from the group consisting of C1-C12 alkyl amines.

33. The additive package of claim 27, said additive package further including individual quantities of toluene and xylene.

34. The additive package of claim 32, said additive package including equal quantities of toluene and xylene.

35. The additive package of claim 27, said additive package further including a compound selected from the group consisting of 2-ethyl hexyl nitrate, methanol and ethylene glycol.

* * * * *